US007942506B2

(12) United States Patent
Park et al.

(10) Patent No.: US 7,942,506 B2
(45) Date of Patent: May 17, 2011

(54) INKJET PRINTER HEAD AND METHOD TO MANUFACTURE THE SAME

(75) Inventors: Sung Joon Park, Suwon-si (KR); Tae-Jin Kim, Suwon-si (KR); Young Hye Park, Yongin-si (KR); Dai Geun Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 452 days.

(21) Appl. No.: 12/112,170

(22) Filed: Apr. 30, 2008

(65) Prior Publication Data

US 2009/0009562 A1 Jan. 8, 2009

(30) Foreign Application Priority Data

Jul. 2, 2007 (KR) ..... 10-2007-0066089

(51) Int. Cl.
*B41J 2/05* (2006.01)

(52) U.S. Cl. ..... 347/63; 347/20; 347/44; 347/47; 347/54; 347/56; 347/61; 347/62; 347/64; 347/65; 347/67; 347/92

(58) Field of Classification Search ..... 347/56, 347/61, 62, 63, 64, 67
See application file for complete search history.

(56) References Cited

U.S. PATENT DOCUMENTS

| | | | | |
|---|---|---|---|---|
| 5,883,650 | A * | 3/1999 | Figueredo et al. | 347/62 |
| 6,070,969 | A * | 6/2000 | Buonanno | 347/64 |
| 6,328,428 | B1 * | 12/2001 | Keefe et al. | 347/63 |
| 2003/0081076 | A1 * | 5/2003 | Park et al. | 347/65 |
| 2003/0098899 | A1 * | 5/2003 | Jung et al. | 347/54 |
| 2003/0117461 | A1 * | 6/2003 | Park et al. | 347/56 |
| 2007/0103514 | A1 * | 5/2007 | Kwon et al. | 347/56 |
| 2007/0285471 | A1 * | 12/2007 | Park et al. | 347/64 |

FOREIGN PATENT DOCUMENTS

JP 2001-341309 12/2001

* cited by examiner

*Primary Examiner* — Ryan Lepisto
(74) *Attorney, Agent, or Firm* — Stanzione & Kim, LLP

(57) ABSTRACT

An inkjet printer head includes a substrate, an insulating layer having a groove and disposed on the substrate, a heating member having a concavely curved upper surface and disposed on an upper portion of the groove, an electrode to make contact with the heating member to apply electric current to the heating member, a chamber layer disposed on the heating member, and a nozzle layer having one or more nozzles and disposed on the chamber layer. According to the inkjet printer head, the heating member has a curved structure to increase a length of the heating member, so that resistance of the heating member can be increased. Thus, the heating member can stably operate regardless of current variation applied thereto, and the printing work can be performed.

18 Claims, 19 Drawing Sheets

FIG. 1
(CONVENTIONAL)
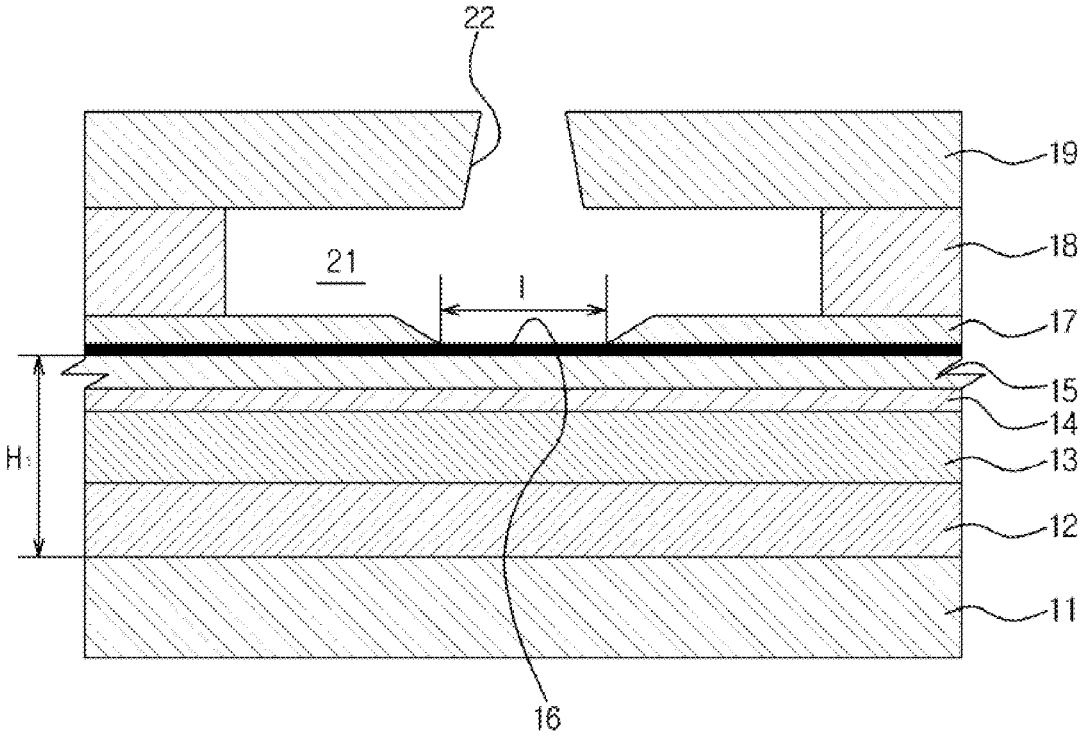

FIG. 2
(CONVENTIONAL)
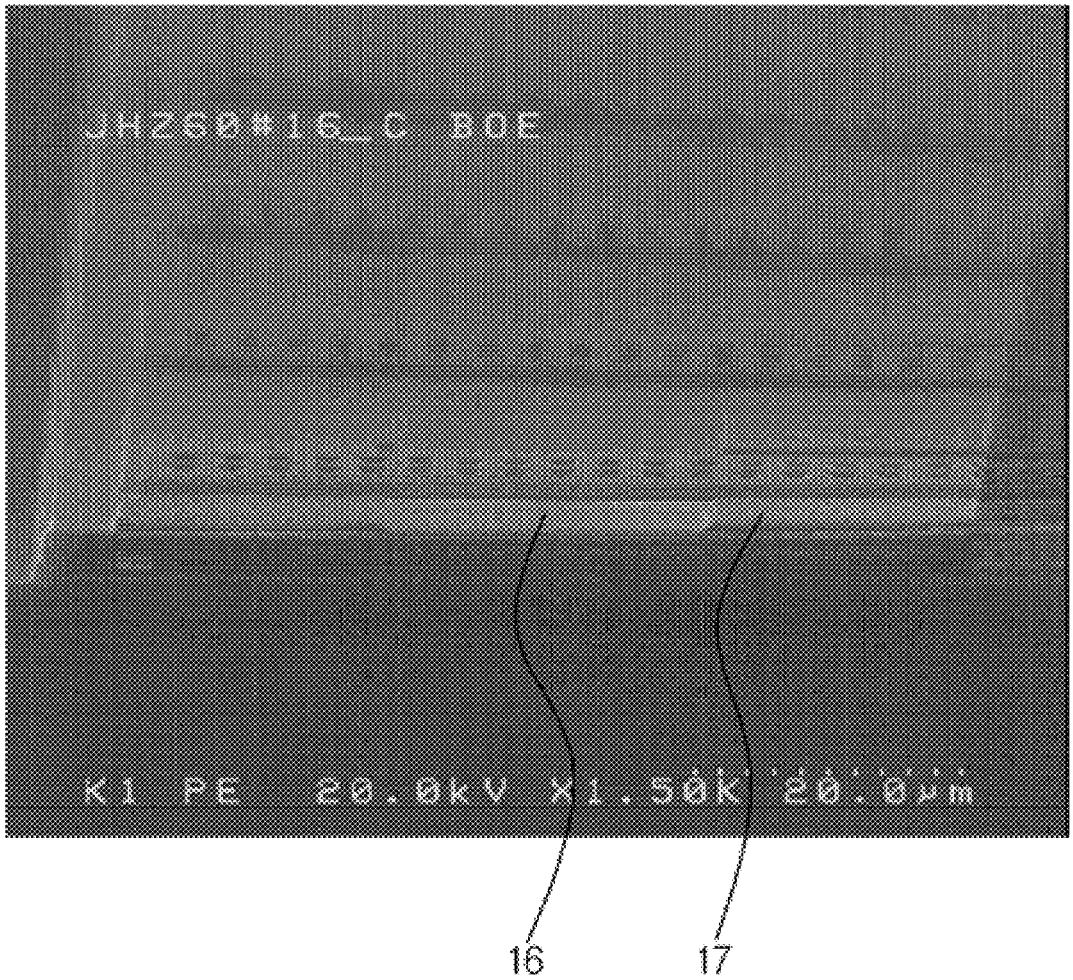

INKJET PRINTER HEAD AND METHOD TO MANUFACTURE THE SAME

CROSS-REFERENCE TO RELATED APPLICATIONS

This application claims priority under 35 U.S.C. §119(a) from Korean Patent Application No. 2007-66089, filed on Jul. 2, 2007, in the Korean Intellectual Property Office, the disclosure of which is incorporated herein in its entirety by reference.

BACKGROUND OF THE INVENTION

1. Field of the Invention

The present general inventive concept relates to an inkjet printer head. More particularly, the present general inventive concept relates to a thermal-driving type inkjet printer head that sprays ink by using bubbles formed when the ink are heated, and a method to manufacture the same.

2. Description of the Related Art

In general, an inkjet image forming apparatus includes an inkjet printer head that sprays ink based on image signals. The inkjet printer head discharges ink droplets based on the image signals to print characters and figures on a print medium. The image forming apparatuses are classified into a shuttle type image forming apparatus, in which the printer head sprays ink while reciprocating in a transfer direction (sub-scanning direction) and an orthogonal direction of the print medium, and an array type image forming apparatus, in which the printer head has a length corresponding to a width of the print medium and thus can perform line printing.

The inkjet printer head may be classified into a thermal-driving type inkjet printer head and a piezoelectric-driving type inkjet printer head according to an ink spraying scheme thereof. The thermal-driving type inkjet printer head includes a heating member that is disposed in an ink chamber and sprays ink droplets through a nozzle by using an expansive force of bubbles formed when the heating member heatsink in the ink chamber. The piezoelectric-driving type inkjet printer head includes piezoelectric member that sprays ink droplets through a nozzle by using pressure applied to ink when the piezoelectric member is transformed by supplied voltage.

FIG. 1 is a sectional view schematically illustrating the conventional thermal-driving type inkjet printer head and FIG. 2 is a SEM (scanning electron microscope) photograph partially illustrating the construction of the conventional thermal-driving type inkjet printer head.

As illustrated in FIGS. 1 and 2, the conventional inkjet printer head includes a silicon substrate 11, a plurality of insulating layers 12 to 15 on the silicon substrate 11, a heating member 16 on an uppermost insulating layer 15, an electrode 17 on the heating member 16, a chamber layer 18 on the electrode 17, and a nozzle layer 19 on the chamber layer 18, in which the electrode 17 supplies power to the heating member 16, the chamber layer 18 forms an ink chamber 21, and the nozzle layer 19.

According to such a conventional inkjet printer head, if pulse type current is applied to the heating member 16 through the electrode 17, heat is generated in the heating member 16 and ink adjacent to the heating member 16 are heated. As the ink is heated and boiled, bubbles are formed and expanded to apply pressure to ink filled in the ink chamber 21. Accordingly, ink in a lower portion of the nozzle 22 is sprayed through the nozzle 22 in the form of droplets.

Ideal pulse type current is not always applied to such a conventional thermal-driving type inkjet printer head. That is, when the inkjet printer head is used, a pulse of the electric current applied to the inkjet printer head may irregularly change according to various factors. With the change in the pulse of the electric current applied to the inkjet printer head, a spraying speed of the ink droplets changes and thus the printing quality may be degraded. In order to maintain a constant spraying speed of the ink droplets regardless of the change in the pulse of the applied electric current, the heating member 16 having a large resistance, for example, is used.

Since the resistance of the heating member 16 may be calculated by an equation ($R=\rho(L/S)$), several methods capable of increasing the resistance of the heating member 16 through the equation can be derived.

In the equation, $\rho$ denotes specific resistance of material constituting the heating member, S denotes a sectional area of the heating member in a flowing direction of electric current, and L denotes a length of the heating member.

The heating member 16 includes material having a large specific resistance, so that the resistance of the heating member 16 can be increased. However, since the well-known material suitable for the heating member 16 is limited, new material must be found. Thus, a development period inevitably increases.

Next, the length of the heating member 16 is increased, so that the resistance of the heating member 16 can be increased. However, as the length of the heating member 16 increases, a bubble generation area is widened. Thus, the heat of the heating member 16 is dispersed instead of being concentrated on the ink in the lower portion of the nozzle 16, so efficiency of the heating member 16 may deteriorate.

Finally, a thickness of the heating member 16 is decreased to reduce the sectional area thereof, so that the resistance of the heating member 16 can be increased. However, as the thickness of the heating member 16 is decreased, durability of the heating member 16 is degraded.

As described above, according to the conventional inkjet printer head in which the heating member 16 is flatly located in the lower portion of the nozzle 22, the resistance of the heating member 16 is not easily increased.

Further, since the thickness between the heating member 16 and the substrate 11 is thick, the heat generated in the heating member 16 is not quickly emitted and accumulated in the inkjet printer head. That is, since the insulating layers 12 to 15 between the heating member 16 and the substrate 11 have poor heat conductivity, the heat generated when the heating member 16 operates is not quickly emitted and continuously accumulated in the inkjet printer head. In order to cause the ink droplets to be stably sprayed, when electric current flows in the heating member 16, the temperature of the heating member 16 increases to a high temperature (e.g. 300° C.) and bubbles must be formed, However, when electric current does not flow in the heating member 16, the temperature of the heating member 16 decreases and bubbles must be contracted to allow ink to be quickly introduced into the ink chamber 21.

According to the conventional inkjet printer head as described above, if the heat of the heating member 16 is not easily emitted, bubbles are not quickly contracted after the ink droplets are sprayed and thus ink may not be easily supplied to the ink chamber 21. Therefore, enhancing a printing speed by increasing a frequency of the electric current supplied to the heating member 16 is difficult.

SUMMARY OF THE INVENTION

The present general inventive concept provides an inkjet printer head, to perform the printing regardless of current variation applied thereto by increasing a resistance of a heating member through modifying a shape of a heating member, and a method to manufacture the same.

The present general inventive concept also provides an inkjet printer head to enable high speed printing by enhancing heat dissipation efficiency of a heating member, and a method to manufacture the same.

Additional aspects and/or utilities of the present general inventive concept will be set forth in part in the description which follows and, in part, will be apparent from the description, or may be learned by practice of the general inventive concept.

The foregoing and/or other aspects and utilities of the general inventive concept may also be achieved by providing an inkjet printer head including a substrate, an insulating layer having a groove and disposed on the substrate, a heating member having a concavely curved upper surface and disposed on an upper portion of the groove, an electrode to make contact with the heating member to apply electric current to the heating member, a chamber layer disposed on the heating member, and a nozzle layer having one or more nozzles and disposed on the chamber layer.

An insulating coating layer having an upper surface recessed at the groove and may be located between the insulating layer and the heating member.

The insulating coating layer may include spin-on-glass (SOG) material.

An isolation layer may be interposed between the heating member and the insulating coating layer.

The electrode may be formed on the heating member.

A distance between the substrate and the heating member may be in a range from 0.5 μm to 5 μm.

The heating member may include one selected from the group consisting of TaN, Ta, TiN and TaAl.

The heating member may have a resistance of more than 10 Ω.

The foregoing and/or other aspects and utilities of the general inventive concept may also be achieved by providing a method to manufacture an inkjet printer head, the method including forming an insulating layer on a substrate, forming a groove by removing a portion of the insulating layer, forming a heating member having a concavely curved upper surface on an upper portion of the groove, forming an electrode to make contact with the heating member to apply electric current to the heating member; forming a chamber layer on the heating member, and forming a nozzle layer having one or more nozzles on the chamber layer.

A length of a heating member may increase by allowing the heating member to having a curved structure, so that a resistance of the heating member can be increased. Consequently, the heating member can stably operate regardless of current variation applied thereto.

The foregoing and/or other aspects and utilities of the general inventive concept may also be achieved by providing an inkjet printer head including a substrate, a nozzle layer having one or more nozzles, and a heating member having a bubble generation area and disposed between the substrate and the nozzle layer, wherein the bubble generation area of the heating member has a non-planar shape to increase an electrical resistance therein.

The non-planar shape of the bubble generation area may include a concavely curved upper surface.

The foregoing and/or other aspects and utilities of the general inventive concept may also be achieved by providing a method to manufacture an inkjet printer head, the method including forming a nozzle layer having one or more nozzles, forming a heating member including a bubble generation area having a non-planar shape to increase an electrical resistance therein, and disposing the heating member between the substrate and the nozzle layer.

Further, according to the inkjet printer head of the present general inventive concept as described above, since a thickness of the insulating layer between the substrate and the heating member is increased, heat dissipation efficiency of the heating member is improved. Consequently, a printing speed can be increased.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 is a sectional view schematically illustrating a conventional thermal inkjet printer head;

FIG. 2 is a SEM photograph partially illustrating a construction of the conventional thermal inkjet printer head;

DETAILED DESCRIPTION OF THE PREFERRED EMBODIMENTS

Figure 3:
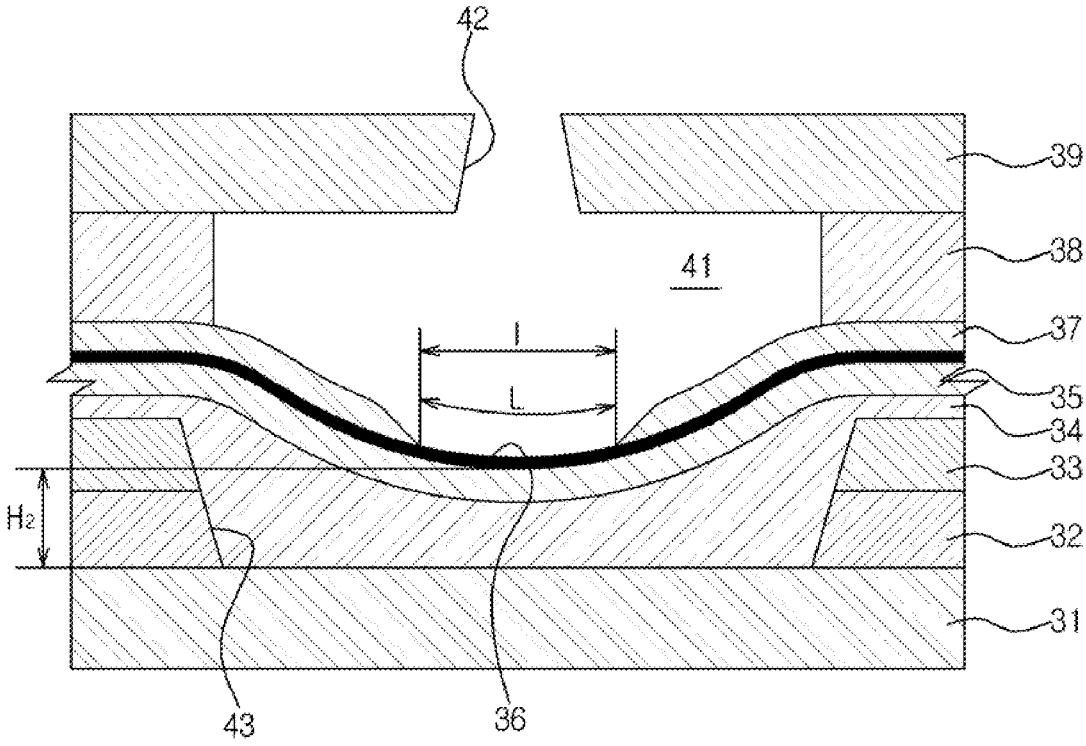
FIG. 3 is a sectional view schematically illustrating an inkjet printer head according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 3, the inkjet printer head according to an embodiment of the present general inventive concept includes a substrate 31, first and second insulating layers 32 and 33, an insulating coating layer 34 and an isolation layer 35 sequentially stacked on the substrate 31, a concave shaped-heating member 36 attached onto the isolation layer 35, an electrode 37 to supply pulse type current to the heating member 36, a chamber layer 38 to form an ink chamber 41 to store ink, and a nozzle layer 39 having a nozzle 42. Hereinafter, the inkjet printer head of the present embodiment will be described in more detail.

The substrate 31 includes a silicon substrate as in the case of a typical semiconductor, and includes the first and second insulating layers 32 and 33 thereon. Each insulating layer 32 and 33 comprises a plurality of insulating material layers, insulates the heating member 36 from the substrate 31, and prevents heat from being emitted from the heating member 36 to the substrate 31. In FIG. 3, the two insulating layers, i.e. the first and second insulating layers 32 and 33, are formed. However, the present general inventive concept is not limited to a particular number of the insulating layers. A groove 43 is formed in the first and second insulating layers 32 and 33. The groove 43 is formed by partially removing the first and second insulating layers 32 and 33, for example, through the well-known photolithography process, dry etching process or wet etching process.

The insulating coating layer 34 is formed on the first and second insulating layers 32 and 33 having the groove 43. The insulating coating layer 34 is formed by coating SOG (spin-on-glass) material on the substrate 31, on which the first and second insulating layers 32 and 33 are stacked, by using a spin coating method. In the present embodiment, the SOG material constituting the insulating coating layer 34 can be replaced with LPSZ. Since the SOG material or the LPSZ has fluidity, the SOG material or the LPSZ flows toward lateral sides of the groove 43 from a central portion of the groove 43 during the spin coating, so that a thickness of the groove 43 is gradually increased from the central portion to the lateral sides of the groove 43.

The isolation layer 35 is formed on the insulating coating layer 34 and a heating material layer 36' (see FIG. 5E) forming the heating member 36 is stacked on the isolation layer 35. The heating material layer 36' is formed by depositing heating material, such as Ta, TaN, TaAl or TiN, by using a thin film deposition method. When the heating material layer 36' makes direct contact with the SOG material or the LPSZ, chemical change occurs therebetween. Thus, the isolation layer 35 is interposed between the heating material layer 36' and the insulating coating layer 34 to prevent the heating material layer 36' from making direct contact with the insulating coating layer 34. Since the isolation layer 35 having a predetermined thickness is formed on the insulating coating layer 34 having a concave upper surface and being provided in the groove 43, the isolation layer 35 is also concavely curved in the groove 43. Further, since the heating material layer 36' having a predetermined thickness is formed on the isolation layer 35, the heating material layer 36' is also concavely curved in the groove 43.

The electrode 37 to supply electric current is formed on the heating material layer 36'. The electrode 37 is partially cut off such that the electrode 37 can partially expose the heating material layer 36' formed on a bottom surface of the nozzle 42 to the ink chamber 41 while covering an upper surface of the heating material layer 36'. One end of the electrode 37 is connected to a power supply (not illustrated) to supply pulse type electric current and an other end thereof is connected to a ground (not illustrated). The heating material layer 36' exposed to the ink chamber 41 forms the heating member 46. As electric current is applied to the heating member 36 through the electrode 37, the heating member 36 boils ink around the heating member 36 to generate bubbles.

Figure 4:
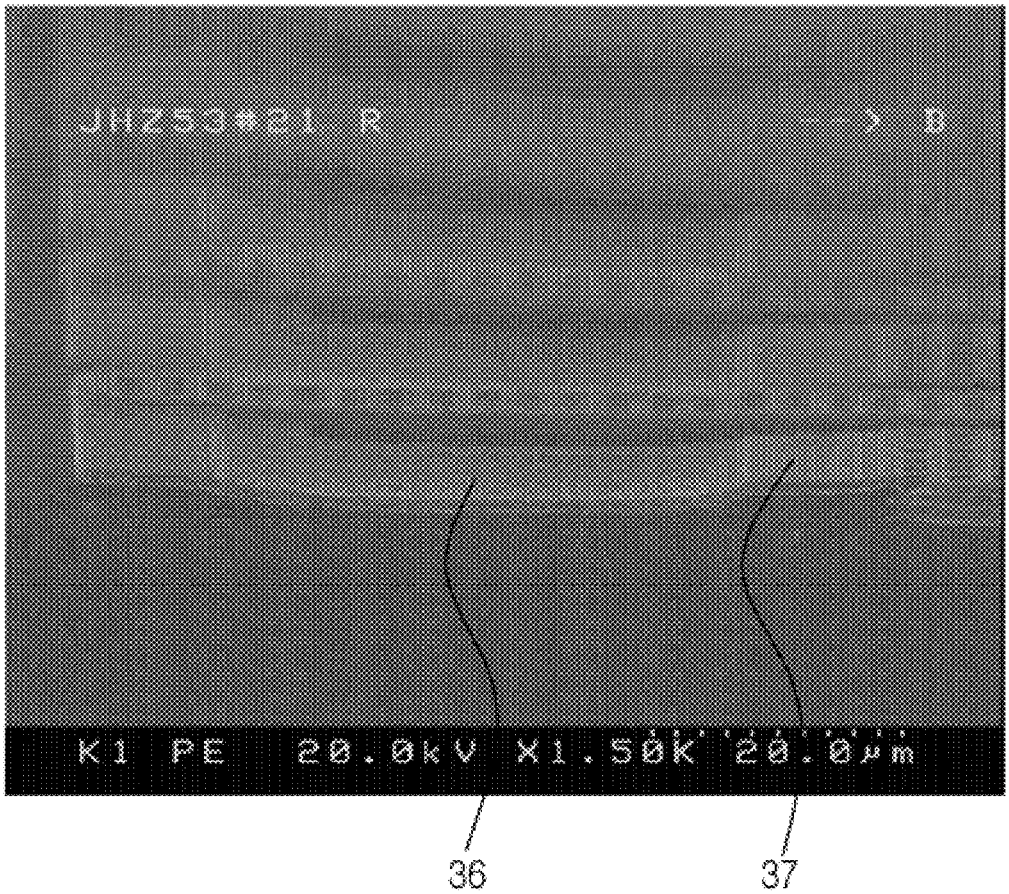
FIG. 4 is a SEM photograph partially illustrating a construction of an inkjet printer head according to one embodiment of the present general inventive concept.

As illustrated in FIGS. 3 and 4, as compared with the conventional flat heating member 16, the curved heating member 36 of the present embodiment has a bubble generation area I the same as that of the conventional flat heating member 16, but a length L of the curved heating member 36 is increased, so that resistance of the curved heating member 36 can be increased even if there is no variation in material or thickness of the curved heating member 36. The curved heating member 36 has a resistance of more than 10 Ω.

The curved heating member 36 of the present embodiment has a shorter distance up to the substrate 31 as compared with the conventional flat heating member 36. That is, a height H2 of the insulating layer between the substrate 31 and the heating member 36 is lower than the height H1 (see FIG. 1) of the conventional insulating layer. Thus, the heat of the heating member 36 can be easily transferred to the substrate 31. In the present embodiment, the height H2 of the insulating layer is in a range from 0.5 μm to 5 μm.

Although not illustrated in the present embodiment, the electrode 37 may also be disposed at the lower portion of the heating member 36. In such a case, the electrode 37 is formed by stacking and patterning a conductive material layer, such as an Al layer, on the isolation layer 35. The heating material layer 36' forming the heating member 36 is stacked on the electrode 37 and the isolation layer 35. Although not illustrated in the present embodiment, at least one of a protection layer and an anti-cavitation layer may be further formed on the heating member 36 and the electrode 37, in which the protection layer protects the heating member 36 and the electrode 37 from ink and the anti-cavitation layer protects the heating member 36 and the electrode 37 from cavitation pressure of bubbles.

The chamber layer 38 and the nozzle layer 39 are sequentially formed on the heating member 36 and the electrode 37. The chamber layer 38 is formed by coating insulating material on the electrode 37 and the heating member 36 and partially removing the heating member 36, for example, through a photolithography process, a dry etching process or a wet etching process. The nozzle layer 39 has the nozzle 42 through which the ink droplets are sprayed, and is coupled to the chamber layer 38 such that the nozzle 42 is located at the upper portion of the heating member 36.

Hereinafter, the method to manufacture the inkjet printer head according to an embodiment of the present general inventive concept will be described with reference to FIGS. 5A to 5I.

Figure 5A:
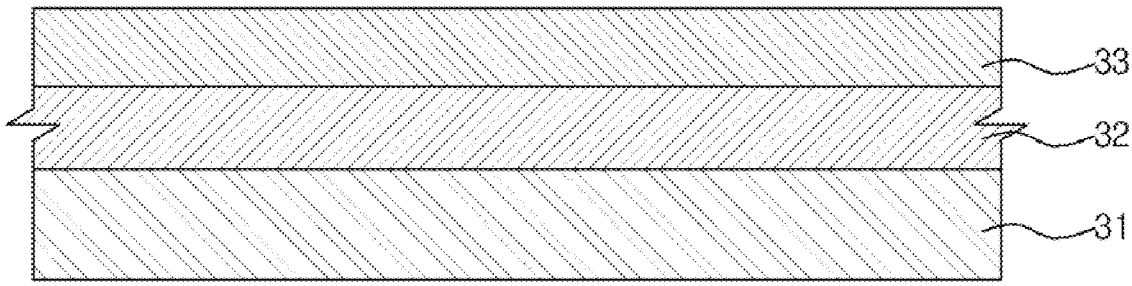
FIGS. 5A to 5I are sectional views sequentially illustrating a procedure to manufacture an inkjet printer head according to an embodiment of the present general inventive concept.

As illustrated in FIG. 5A, the first and second insulating layers 32 and 33 are sequentially stacked on the substrate 31. Each insulating layer 32 and 33 is formed by sequentially stacking a plurality of insulating material layers at a predetermined thickness.

Figure 5B:
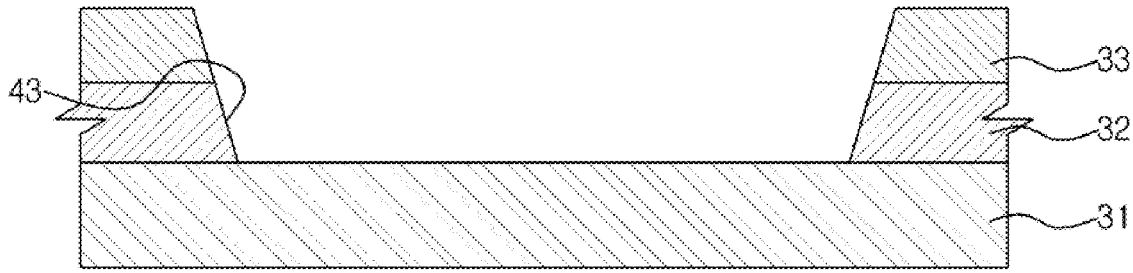

As illustrated in FIG. 5B, each insulating layer 32 and 33 is partially removed, for example, through a photolithography process, a dry etching process or a wet etching process to form the groove 43. In the operation of forming the groove 43, the first insulating layer 32 may also be completely removed up to the upper surface of the substrate 31 such that the upper surface of the substrate 31 is exposed. Although not illustrated in FIG. 5B, a portion of the first insulating layer 32 may remain such that that the upper surface of the substrate 31 is covered with the first insulating layer 32 having a predetermined thickness.

Figure 5C:
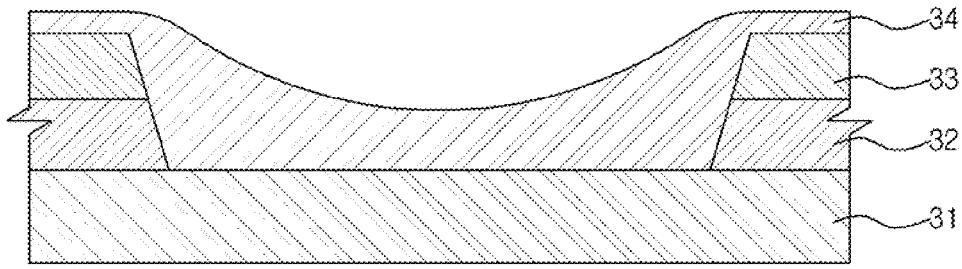

As illustrated in FIG. 5C, after the groove 43 is formed, the insulating coating layer 34 is stacked on the substrate 31 and the first and second insulating layers 32 and 33. The insulating coating layer 34 is formed by coating the SOG material or the LPSZ by using a spin coating method. When the SOG material or the LPSZ is coated, since the SOG material or the LPSZ has fluidity, the SOG material or the LPSZ flows toward the lateral sides from the central portion of the groove 43. Thus, the SOG material or the LPSZ is coated in such a manner that the thickness of the groove 43 is gradually increased from the central portion to the lateral sides of the groove 43. Then, the SOG material or the LPSZ is cured through a baking process or a curing process to form the insulating coating layer 34 having a concave upper surface.

Figure 5D:
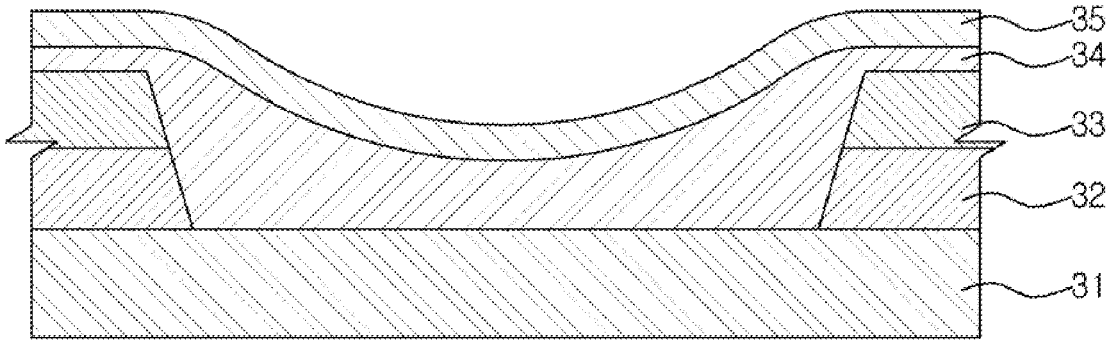
Figure 5E:
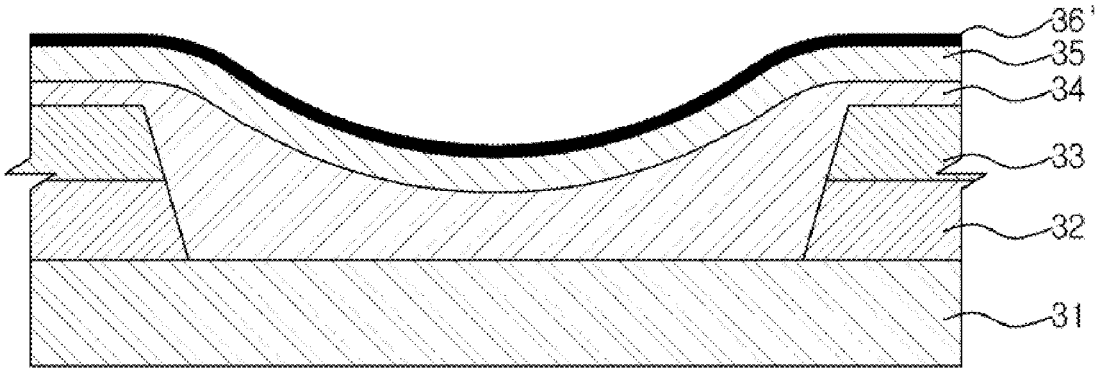

As illustrated in FIG. 5D, after the insulating coating layer 34 is formed, the isolation layer 35 having a predetermined thickness is stacked on the insulating coating layer 34. As illustrated in FIG. 5E, the heating material layer 36' having a predetermined thickness is stacked on the isolation layer 35. Accordingly, the isolation layer 35 and the heating material layer 36' are concavely formed at the groove 43. The heating material layer 36' is formed by depositing heating material, such as Ta, TaN, TaAl or TiN, by using a thin film deposition method such as sputtering and then patterning the heating material.

Figure 5F:
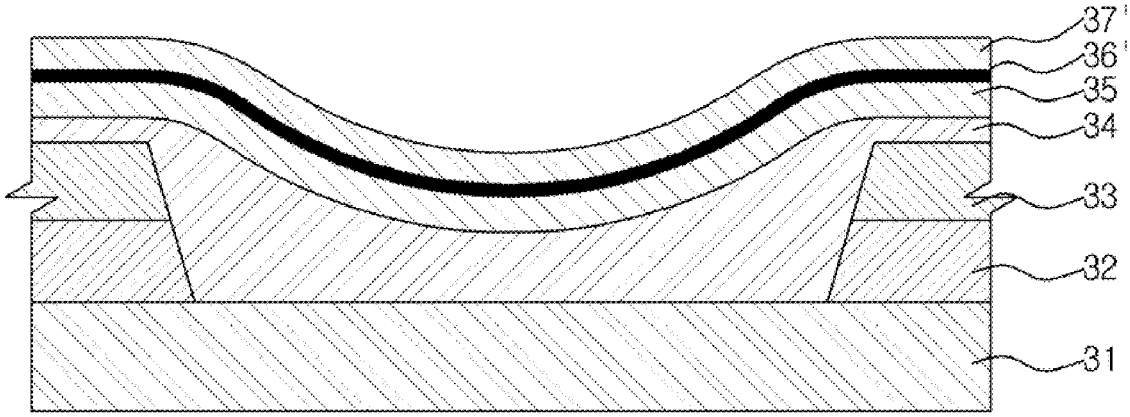
Figure 5G:
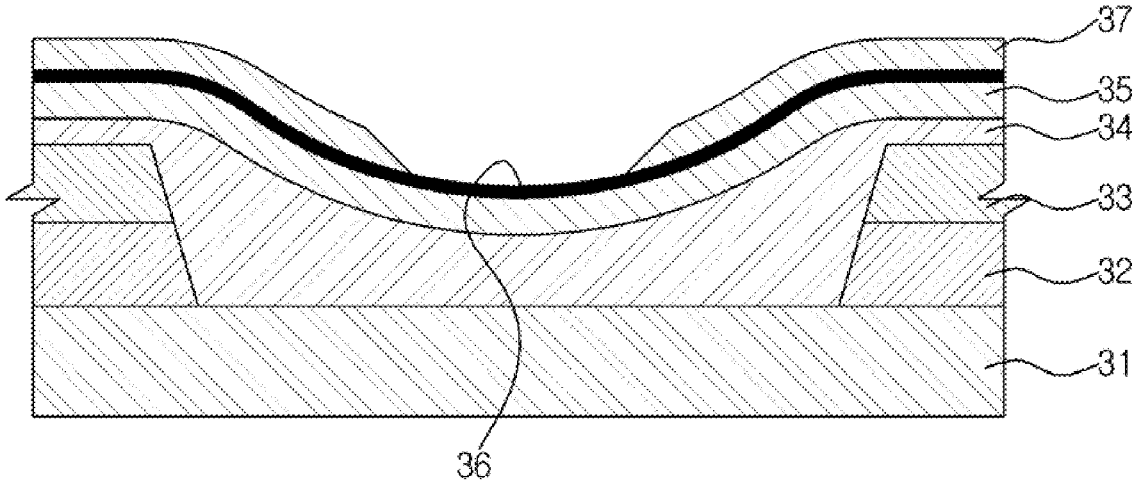

As illustrated in FIGS. 5F and 5G after the heating material layer 36' is formed, the conductive material layer 37' such as an aluminum layer is stacked on the heating material layer 36'. Then, the conductive material layer 37' is divided about the central portion of the groove 43 by removing a portion of the conductive material layer 37', for example, through a dry etching process or a wet etching process, so that the electrode 37 is formed. A portion of the heating material layer 36', which is exposed through the electrode 37 divided about the central portion of the groove 43, forms the heating member 36. One end of the electrode 37 is connected to a power supply to supply electric current and an other end thereof is connected to a ground.

Figure 5H:
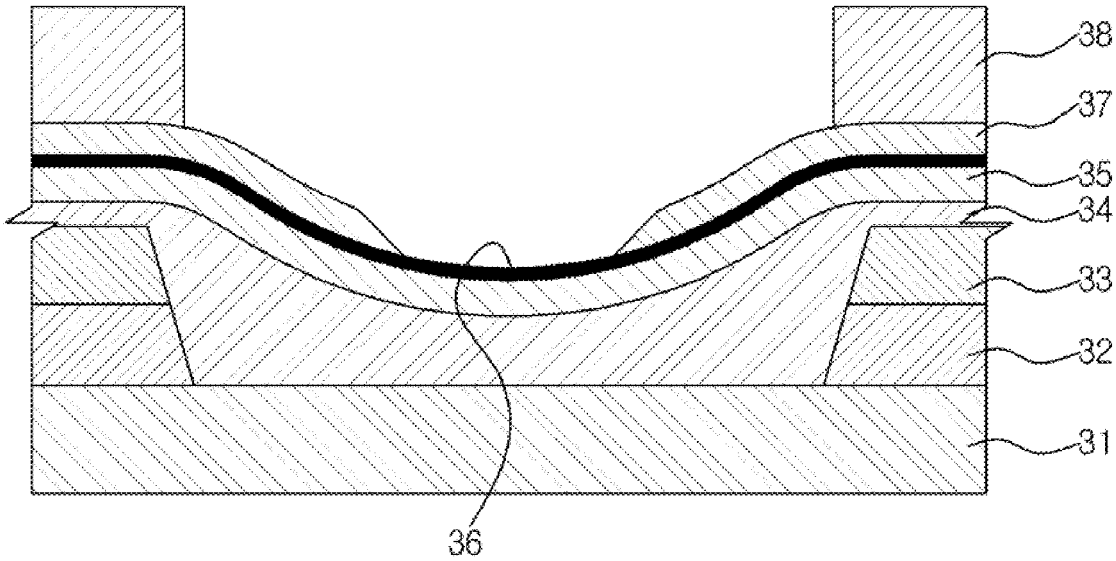

As illustrated in FIG. 5H, after the electrode 37 is formed, the chamber layer 38 that forms the ink chamber 41 to store ink is stacked on the heating member 36. The chamber layer 38 is formed by coating insulating material on the electrode 37 and the heating member 36 and partially removing the heating member 36, for example, through a photolithography process, a dry etching process or a wet etching process.

Figure 5I:
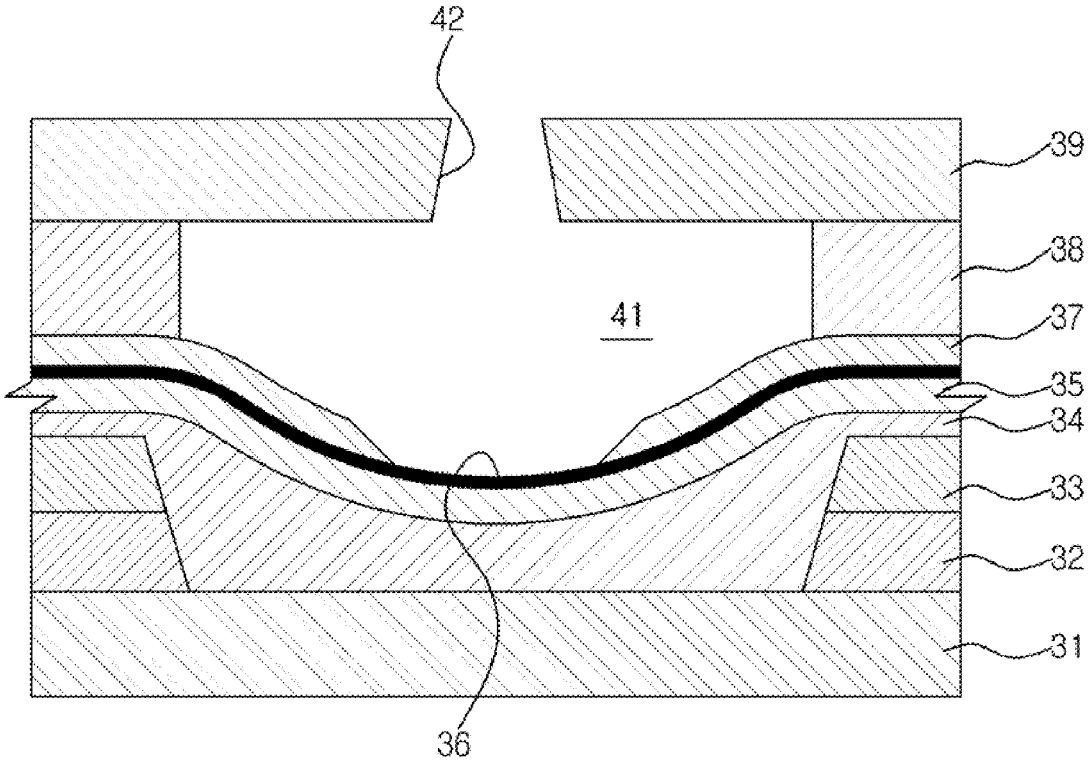

As illustrated in FIG. 5I, the nozzle layer 39 having the nozzle 42 is stacked on the chamber layer 38 such that the nozzle 42 is located at the central portion of the heating member 36 to complete fabrication of the inkjet printer head. In the present embodiment, the nozzle layer 39 can be integrally formed with the chamber layer 38.

FIGS. 6 to 11 are graphs illustrating experimental results obtained by comparing the conventional inkjet printer head illustrated in FIGS. 1 and 2 with the inkjet printer head of the present embodiment illustrated in FIGS. 3 and 4, i.e. FIGS. 6 to 11 illustrate the printing states caused by the inkjet printer heads and temperature variation during operations of the inkjet printer heads.

The experiment was performed using a shuttle type image forming apparatus. According to the experiment, a cartridge equipped with a conventional inkjet printer head and an inkjet printer head of the present embodiment was shuttled ten times to print 10 lines on a printing medium, and then the printing states and the temperature variation caused by each inkjet printer head was observed.

As illustrated in FIGS. 1 and 2, in the conventional inkjet printer head used for the experiment, the heating member 16 has a flat structure and the height H1 of the insulating layer between the substrate 11 and the heating member 16 is 3.23 μm. As illustrated in FIGS. 3 and 4, in the inkjet printer head of embodiments of the present general inventive concept, the heating member 36 has a curved structure and the height H2 of the insulating layer between the substrate 31 and the heating member 36 is 1.20 μm.

Figure 6:
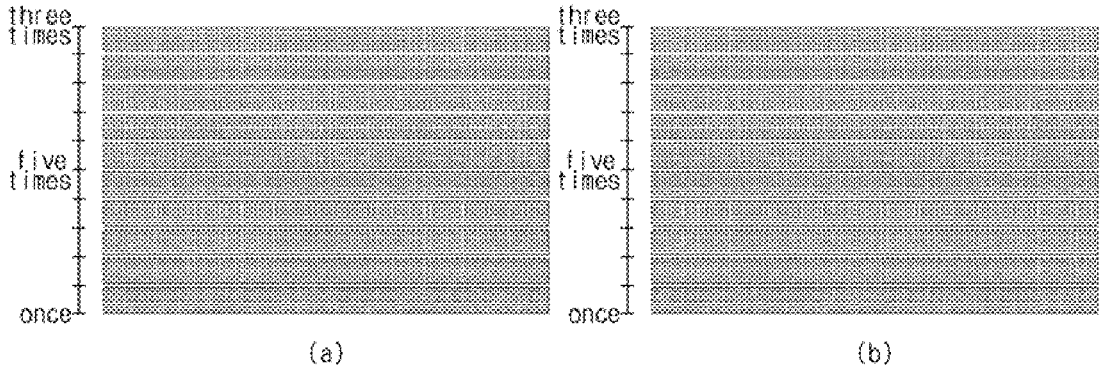
FIG. 6 illustrates graphs representing printing states achieved by a conventional inkjet printer head and an inkjet printer head of an embodiment of the present general inventive concept when current of 11 kHz is applied.
Figure 7:
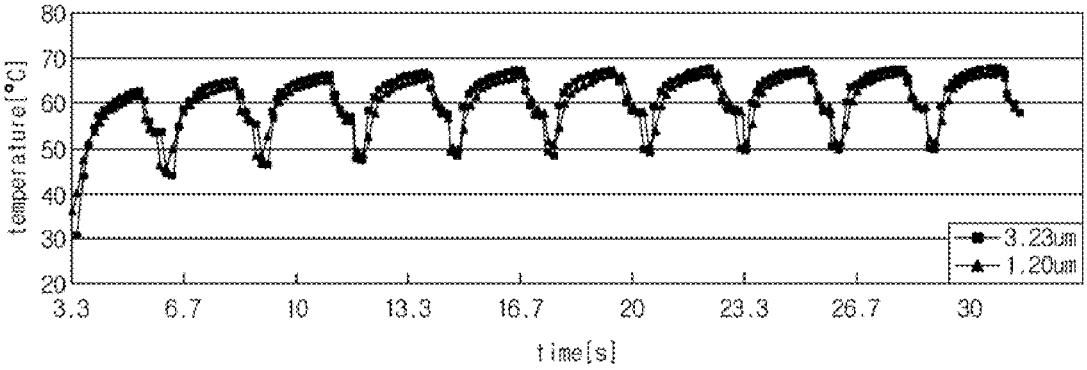
FIG. 7 is a graph illustrating temperature variation of a conventional inkjet printer head and an inkjet printer head of the present general inventive concept when of 11 kHz is applied.

In FIGS. 6 and 7, electric current of 11 kHz is supplied to the conventional inkjet printer head and the inkjet printer head of the present embodiment, and then 10 lines are printed through the inkjet printer heads, respectively. FIG. 6A illustrates the 10 lines printed through the conventional inkjet printer head. As can be seen from FIG. 6A, the 10 lines are printed. The printing direction is from a left side to a right side on a basis of a drawing. That is, the printing is performed while moving the cartridge having the inkjet printer head from the left side to the right side. FIG. 6B illustrates the 10 lines printed through the inkjet printer head of the present embodiment. As can be seen from FIG. 6B, the 10 lines are printed.

FIG. 7 is a graph illustrating temperature of each inkjet printer head measured while the 10 lines are printed through each inkjet printer head. As can be seen from the graph, while each inkjet printer head is printing one line, the temperature of each inkjet printer head is continuously increased until printing work ends. This is because the heat generated through the consecutive operations of each heating member 16 and 36 is accumulated while the printing work is being performed. Further, the temperature of each inkjet printer head is decreased when each inkjet printer head shifted into a printing start position in order to print a respective subsequent line after printing one line. This is because each heating member 16 and 36 does not generate heat and the accumulated heat is emitted while each inkjet printer head is being shifted into the printing start position. Such a temperature variation is repeated while the 10 lines are being printed.

Figure 8:
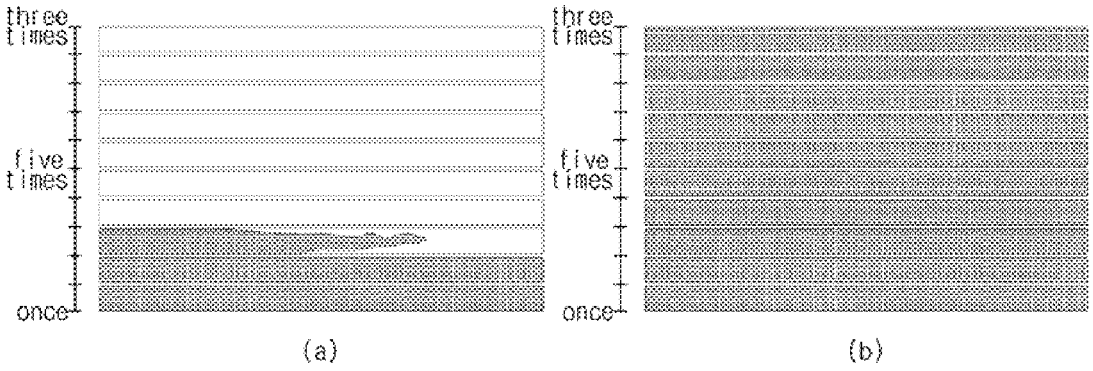
FIG. 8 illustrates graphs representing printing states achieved by a conventional inkjet printer head and an inkjet printer head of the present general inventive concept when current of 12 kHz is applied.
Figure 9:
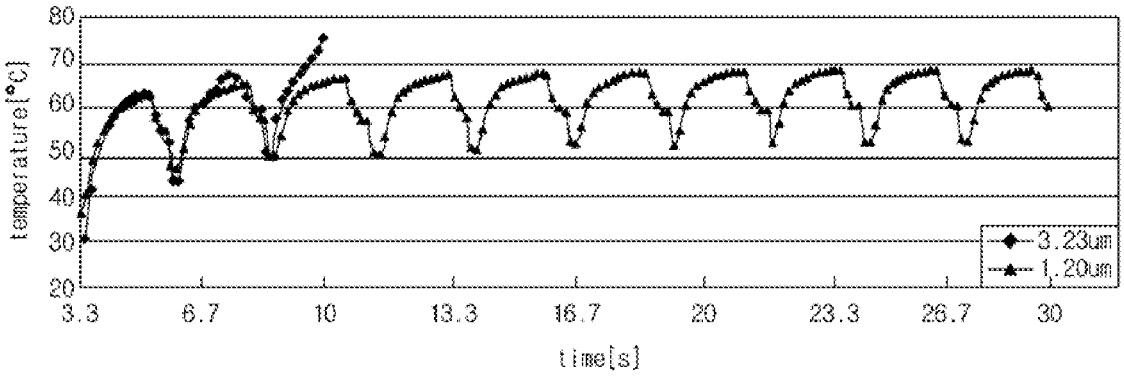
FIG. 9 is a graph illustrating temperature variation of a conventional inkjet printer head and an inkjet printer head of the present general inventive concept when of 12 kHz is applied.

In FIGS. 8 and 9, electric current of 12 kHz is supplied to the conventional inkjet printer head and the inkjet printer head of the present embodiment, subsequently 10 lines are printed through the inkjet printer heads, respectively. FIG. 8A illustrates the 10 lines printed through the conventional inkjet printer head. As can be seen from FIG. 8A, the printing can be performed when printing the first and second lines, but the printing is degraded after a middle portion of the third line. However, as illustrated in FIG. 8B, for example, the inkjet printer head of the present embodiment prints the 10 lines.

A performance difference between the two printer heads can be confirmed through the temperature variation graph illustrated in FIG. 9. That is, as illustrated in FIG. 9, the inkjet printer head of an embodiment of the present general inventive concept illustrates a pattern, in which temperature is repeatedly increased and decreased 10 times while the 10 lines are being printed. However, the temperature of the conventional inkjet printer head is rapidly increased when printing the third line, and then the printing is not performed any more.

Figure 10:
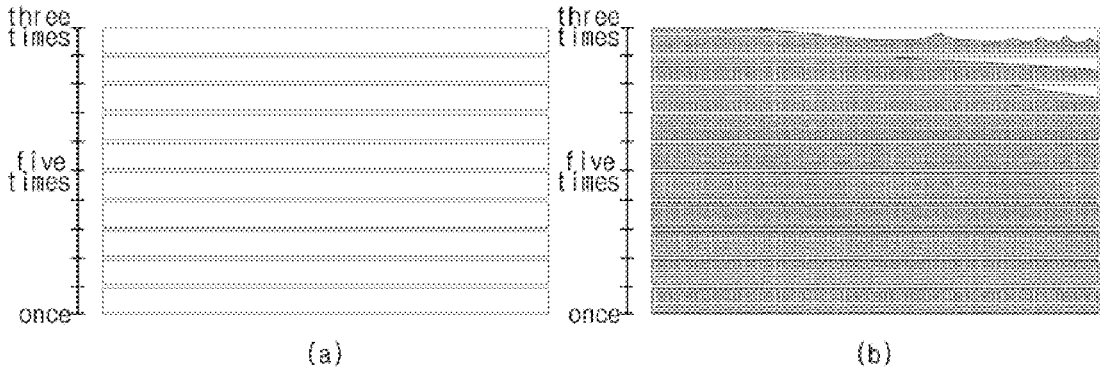
FIG. 10 are graphs representing printing states achieved by a conventional inkjet printer head and an inkjet printer head of the present general inventive concept when current of 13 kHz is applied.
Figure 11:
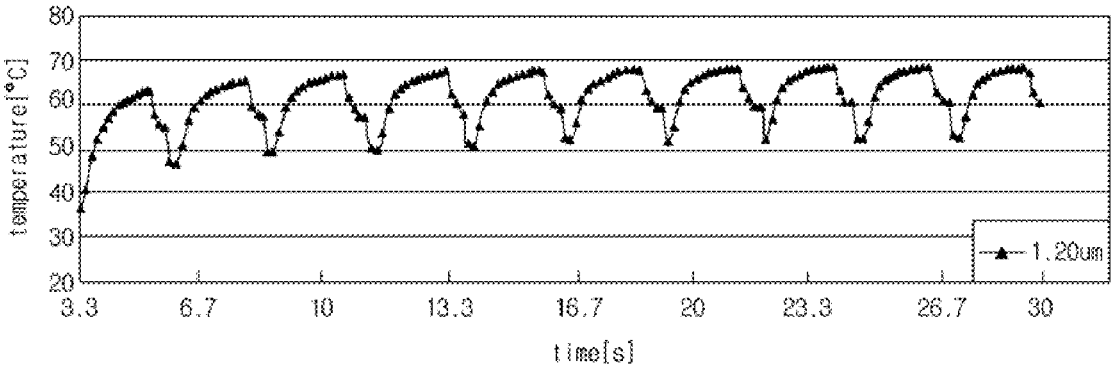
FIG. 11 is a graph illustrating temperature variation of a conventional inkjet printer head and an inkjet printer head of the present general inventive concept when of 13 kHz is applied.

In FIGS. 10 and 11, electric current of 13 kHz is supplied to the conventional inkjet printer head and the inkjet printer head of the present embodiment, subsequently 10 lines are printed through the inkjet printer heads, respectively. As can be seen from FIG. 10A, the conventional inkjet printer head does not operate when the electric current of 13 kHz is applied. However, the inkjet printer head of the present embodiment prints almost the 10 lines.

Further, as illustrated in the graph of FIG. 11, the inkjet printer head of the present embodiment illustrates a pattern in which the temperature is repeatedly increased and decreased while each line is being printed.

Such experimental results can be summarized by the following table.

TABLE

| | Etching method | Height H of insulating layer | Limitation frequency |
|---|---|---|---|
| Conventional inkjet printer head | | 3.23 μm | 12 kHz |
| Inkjet printer head of present embodiment | Dry | 1.20 μm | 13 kHz |

That is, as compared with the conventional inkjet printer head, according to the inkjet printer head of the present embodiment, the first and second insulating layers 32 and 33 are removed using a dry etching method such that the height H2 between the substrate 31 and the heating member 36 is reduced to 1.20 μm lower than the conventional height H1 3.23 μm. In the conventional inkjet printer head, the applicable frequency is limited to 12 kHz. However, in the inkjet printer head of the present embodiment, the applicable frequency can be increased to 13 kHz.

Accordingly, various embodiments of the inkjet printer head of the present general inventive concept can increase a printing speed as compared with the conventional inkjet printer head.

Although various embodiments of the present general inventive concept have been illustrated and described, it would be appreciated by those skilled in the art that changes may be made in these embodiments without departing from the principles and spirit of the general inventive concept, the scope of which is defined in the appended claims and their equivalents.

What is claimed is:

1. An inkjet printer head, comprising:
a substrate;
an insulating layer having a groove and disposed on the substrate;
a heating member having a concavely curved upper surface and disposed on an upper portion of the groove;
an electrode to make contact with the heating member to apply electric current to the heating member;
a chamber layer disposed on the heating member; and
a nozzle layer having one or more nozzles and disposed on the chamber layer.

2. The inkjet printer head as claimed in claim 1, wherein an insulating coating layer is located between the insulating layer and the heating member, the insulation coating layer having an upper surface recessed at the groove.

3. The inkjet printer head as claimed in claim 2, wherein the insulating coating layer comprises:
spin-on-glass (SOG) material.

4. The inkjet printer head as claimed in claim 3, wherein an isolation layer is interposed between the heating member and the insulating coating layer.

5. The inkjet printer head as claimed in claim 1, wherein the electrode is formed on the heating member.

6. The inkjet printer head as claimed in claim 1, wherein a distance between the substrate and the heating member is in a range from 0.5 μm to 5 μm.

7. The inkjet printer head as claimed in claim 1, wherein the heating member comprises:
one selected from the group consisting of TaN, Ta, TiN and TaAl.

8. The inkjet printer head as claimed in claim 1, wherein the heating member has a resistance of more than 10 Ω.

9. A method to manufacture an inkjet printer head, the method comprising:
forming an insulating layer on a substrate;
forming a groove by removing a portion of the insulating layer;
forming a heating member having a concavely curved upper surface on an upper portion of the groove;
forming an electrode to make contact with the heating member to apply electric current to the heating member;
forming chamber layer on the heating member; and
forming a nozzle layer having one or more nozzles on the chamber layer.

10. The method as claimed in claim 9, wherein, before the forming of the heating member, an insulating coating layer having an upper surface recessed at the groove is formed by coating insulating material on the insulating layer.

11. The method as claimed in claim 10, wherein the insulating material contained in the insulating coating layer comprises:
spin-on-glass (SOG) material and the insulating coating layer is coated using a spin coating method.

12. The method as claimed in claim 11, wherein, before the forming of the electrode, an isolating layer is formed on the insulating coating layer.

13. The method as claimed in claim 9, wherein a distance between the substrate and the heating member is in a range from 0.5 μm to 5 μm.

14. The method as claimed in claim 9, wherein the electrode is formed by coating conductive material on the heating member and then patterning the conductive material.

15. The method as claimed in claim 9, wherein the heating member is formed using one selected from the group consisting of TaN, Ta, TiN and TaAl.

16. An inkjet printer head, comprising:
a substrate;
a nozzle layer having one or more nozzles;
a heating member having a bubble generation area and disposed between the substrate and the nozzle layer; and
an electrode covering a surface of the heating member and having an opening to expose a portion of the heating member opposite a nozzle of the nozzle layer,
wherein the bubble generation area of the heating member has a non-planar shape, and
the portion of the heating member opposite the nozzle has a concave shape.

17. The inkjet printer head as claimed in claim 16, wherein the non-planar shape of the bubble generation area comprises:
a concavely curved upper surface.

18. A method to manufacture an inkjet printer head, the method comprising:
forming a heating member on a substrate, the heating member including a bubble generation area having a non-planar shape;
forming a nozzle layer having one or more nozzles on the heating member; and
forming an electrode between the heating member and the nozzle layer to cover the heating member and to have at least one opening opposite a nozzle of the nozzle layer,
wherein a portion of the heating member opposite the nozzle has a concave shape.

* * * * *